United States Patent [19]

Eizenhoefer

[11] 4,401,880

[45] Aug. 30, 1983

[54] DEVICE TO MELT ICE AND SNOW ON A ROOF STRUCTURE

[76] Inventor: Claude E. Eizenhoefer, 3421 Kent St., St. Paul, Minn. 55112

[21] Appl. No.: 322,845

[22] Filed: Nov. 19, 1981

[51] Int. Cl.[3] ..... H05B 1/00

[52] U.S. Cl. ..... 219/213; 52/11; 219/325; 219/528; 219/530; 219/535

[58] Field of Search ..... 219/200, 201, 213, 345, 219/301, 325, 528, 530, 535, 540, 548, 549; 244/134 R; 338/214, 240; 52/11, 15, 16; 30/140; 165/47, 48 R; 37/11; 138/33; 126/271.1, 271.2 A

[56] References Cited

U.S. PATENT DOCUMENTS

| | | | |
|---|---|---|---|
| 1,464,280 | 8/1923 | Hynes | 219/544 |
| 2,507,039 | 5/1950 | Miller | 219/213 |
| 2,511,910 | 6/1950 | Foote | 338/240 X |
| 3,041,441 | 6/1962 | Elbert et al. | 219/528 X |
| 3,141,955 | 7/1964 | Culpepper | 219/213 |
| 3,233,078 | 2/1966 | Siemianowski | 219/213 |
| 3,281,578 | 10/1966 | Chapman, Jr. | 219/528 |
| 3,388,738 | 6/1968 | Dery | 219/213 X |
| 3,521,029 | 7/1970 | Toyooka et al. | 219/201 |
| 3,725,638 | 4/1973 | Solin et al. | 219/213 |
| 3,784,783 | 1/1974 | Gray | 219/213 |
| 3,821,512 | 6/1974 | Stanford | 219/213 |
| 4,081,657 | 3/1978 | Stanford | 219/213 |
| 4,134,002 | 1/1979 | Stanford | 219/213 |
| 4,308,696 | 1/1982 | Schroeder | 52/11 |

FOREIGN PATENT DOCUMENTS

| | | | |
|---|---|---|---|
| 267335 | 6/1950 | Switzerland | 219/213 |
| 673097 | 6/1952 | United Kingdom | 219/213 |

*Primary Examiner*—Volodymyr Y. Mayewsky
*Attorney, Agent, or Firm*—Leo Gregory

[57] ABSTRACT

A device to melt ice and snow on a roof structure to provide channels for the drainage of water, the device being an elongated, rigid structure having a hinged end portion to extend over a gutter, having means in connection with the other end portion thereof to removably support the same, the device being formed of a highly conductive material having heating cables in contact with the outer structure thereof for heat transference and having a plurality of apertures in the upper surface thereof, the device being particularly designed to be installed either upon a dry roof or upon a snow or ice covered roof.

10 Claims, 7 Drawing Figures

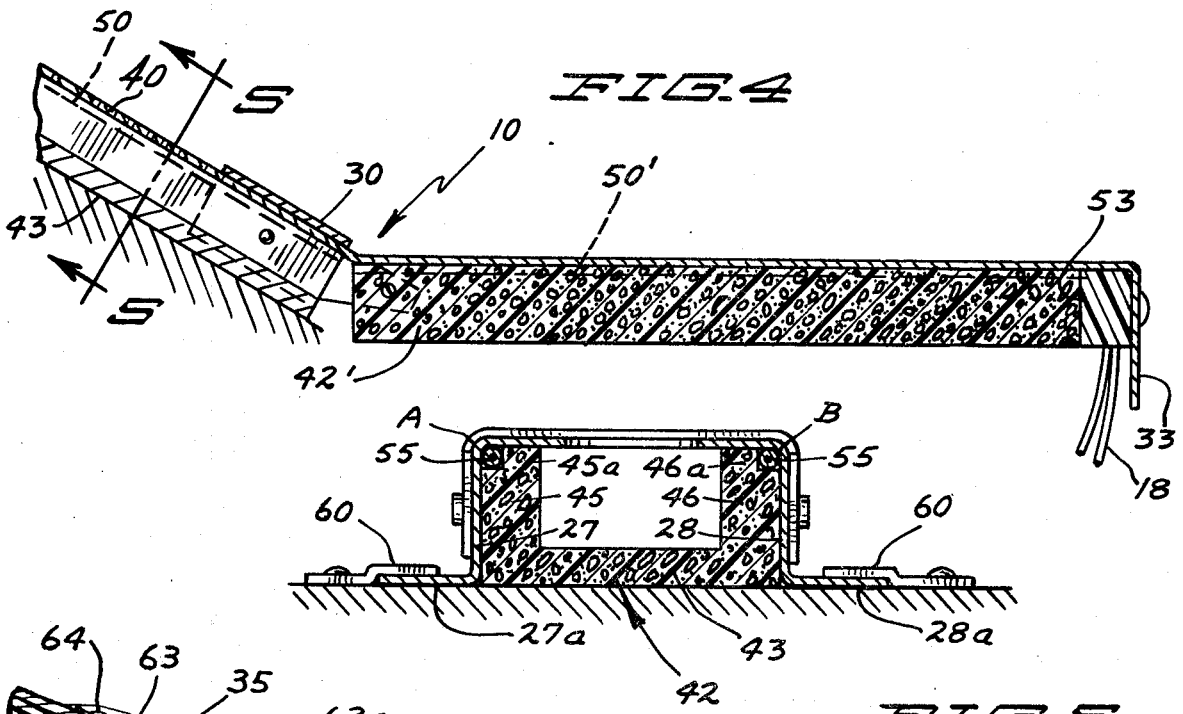
FIG. 4
FIG. 5
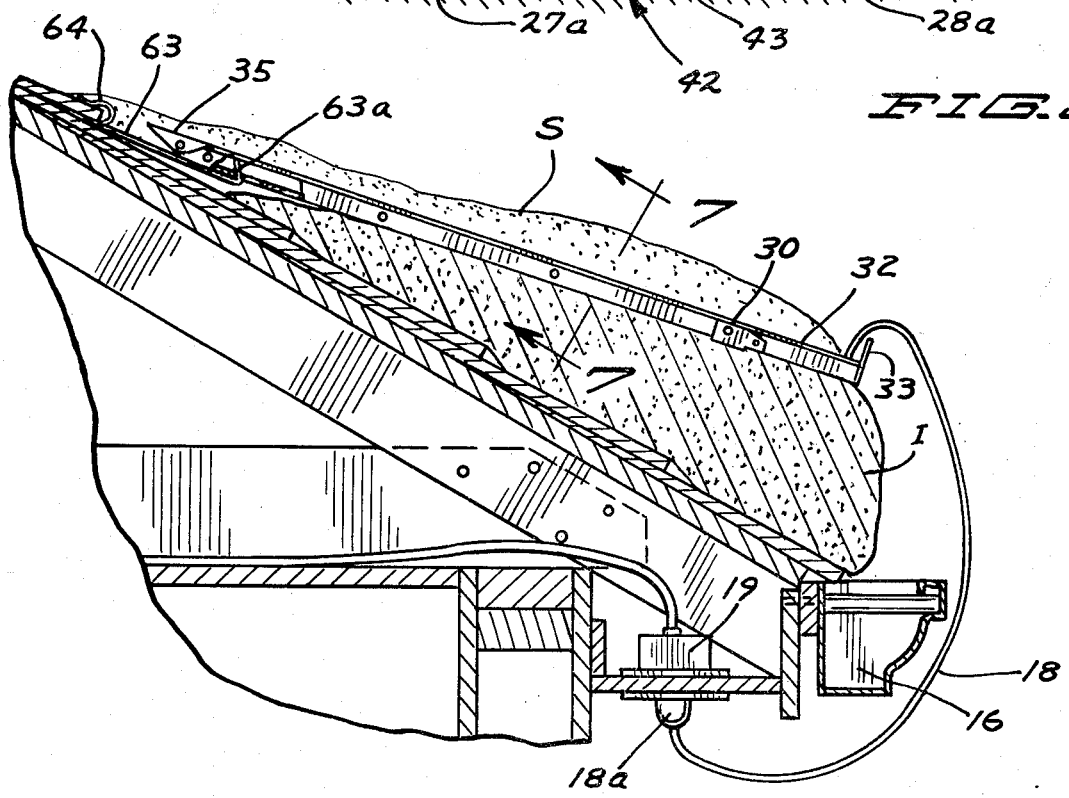
FIG. 6
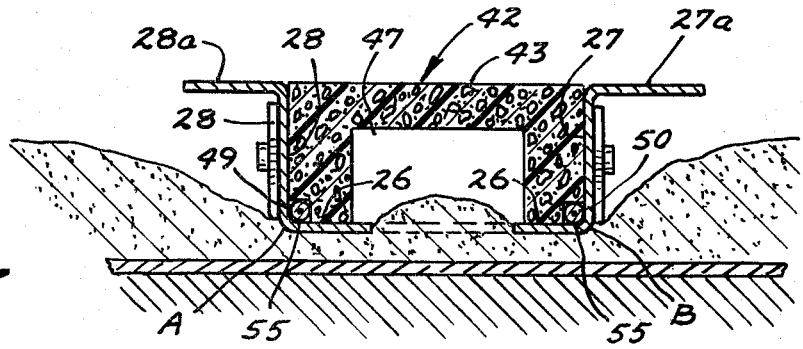
FIG. 7

DEVICE TO MELT ICE AND SNOW ON A ROOF STRUCTURE

BACKGROUND OF THE INVENTION

1. Field of the Invention

This invention is in the field of roof ice and snow melting devices.

2. Description of the Prior Art

It is customarily the practice for melting ice and snow on roof structures to use flexible heating cables which are installed in a zigzag fashion on the edge portions of a roof to the extent of the soffit structure and for a substantial length of the roof and have one line thereof extending through an adjacent gutter and a downspout for the drainage of water. The flexible cable requires being secured at frequent intervals to the roofing material requiring penetration of and damage to the roofing material and requires frequent replacement. A heating cable is relatively difficult to install and generally requires the service of an experienced installer and requires clement weather for its installation.

It is desirable to have as an improved structure, a device which can be readily installed or placed in position under practically any weather condition and without a great deal of effort and which can be particularly and precisely positioned where required.

SUMMARY OF THE INVENTION

The invention herein relates to a novel development in a device for melting ice and snow from a roof surface, which device may be particularly positioned and readily installed without the requirement of expert assistance.

It is an object of this invention to provide a device for melting ice and snow from a roof surface which is a rigid member having sufficient length to extend over the unheated or soffit portion of a roof edge and be maintained in position without damage to the roofing material.

It is another object of this invention to provide a device such as indicated in the previous object, said device comprises a rigid housing having sufficient length to extend upwardly above the unheated edge or soffit portion of a roof and to have one end portion hingedly secured to be angled to overlie a gutter, heating cables are disposed within the housing of said device in contact with the outer housing for heat transference and having a line running therefrom to a power source.

More specifically it is an object of this invention to provide a device for melting ice and snow from a roof surface, said device comprising a housing formed as an elongated channel shaped body having heating cables therein transferring heat through the housing, the housing being formed of a material highly conductive for heat transfer, said device having an end portion thereof hingedly secured to be readily angled to overlie an adjacent gutter pipe and having means at its other end portion to removably secure said device.

These and other objects and advantages of the invention will be set forth in the following description made in connection with the accompanying drawings in which like reference characters refer to similar parts throughout the several views.

BRIEF DESCRIPTION OF THE DRAWINGS

FIG. 4 is a view in longitudinal vertical section taken on line 4—4 of FIG. 3 as indicated;

FIG. 5 is a view in vertical cross section taken on line 5—5 of FIG. 4 as indicated;

FIG. 6 is a broken view in side elevation showing the device in an alternate operating position, and FIG. 7 is a view in vertical cross section taken on line 7—7 of FIG. 6 as indicated.

DESCRIPTION OF A PREFERRED EMBODIMENT

Figure 1:
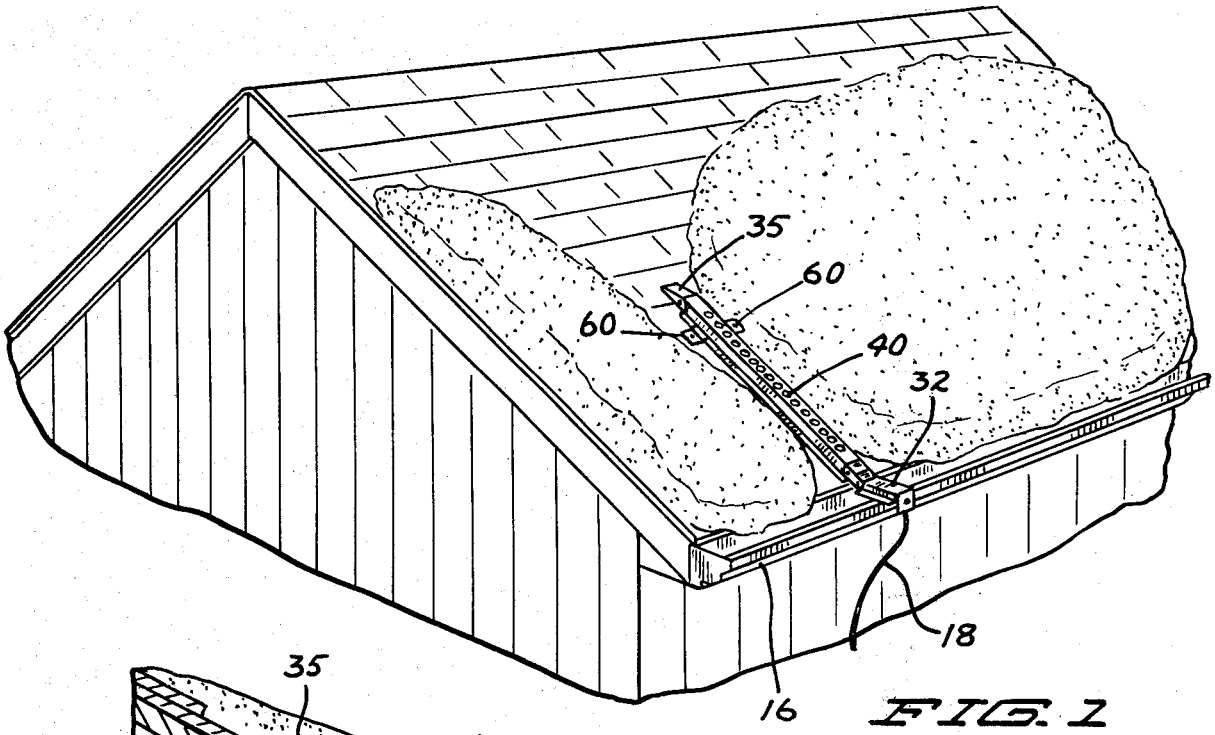
FIG. 1 is a view in perspective showing the structure of the invention in operating position.

Referring to the drawings, the device comprising the invention herein is indicated generally by the reference numeral 10.

Figure 2:
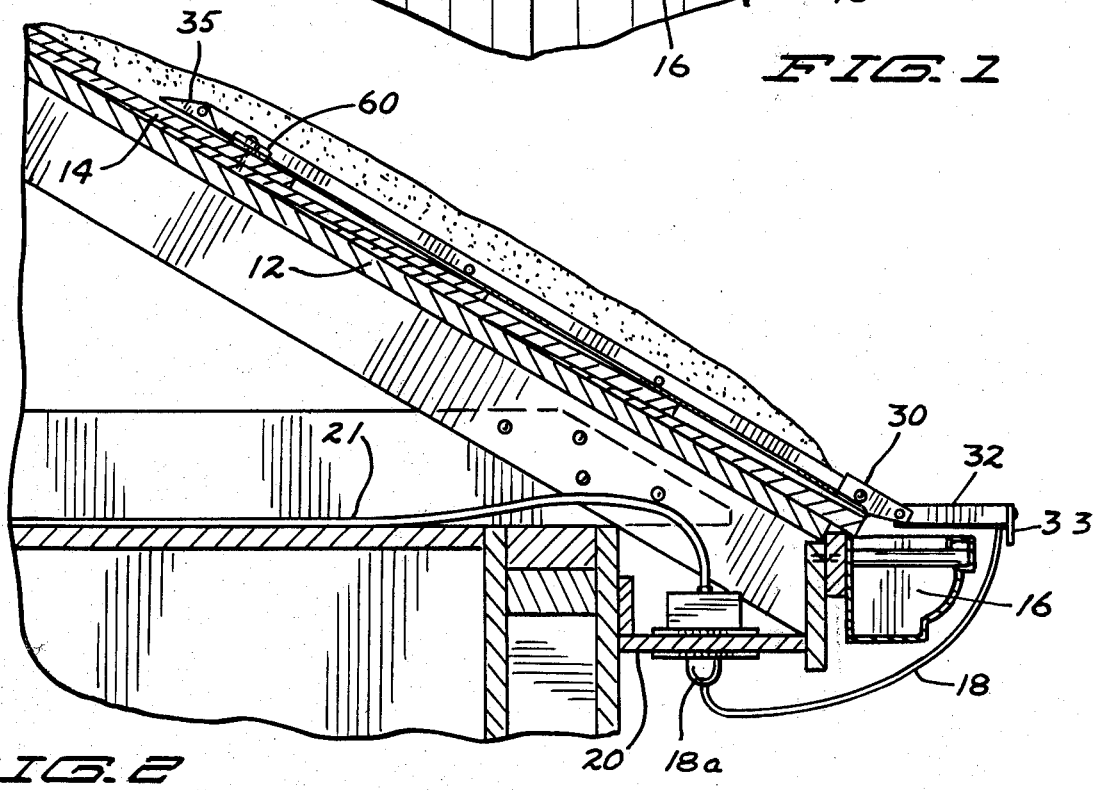
FIG. 2 is a broken view in side elevation.

As shown in FIGS. 1 and 2, said device is in an operating position on a roof structure 12 overlying the roof surface 14 thereon and extending somewhat beyond to overlie a gutter pipe 16. Extending from said device is an electrical line 18 having a terminal **18*a* plugged into an outlet box 19 carried on the inner side of a soffit 20 and in a conventional manner being in circuit with a power source by means of a line 21**.

Referring more particularly to FIGS. 2–5, the device in its present embodiment is shown comprising an elongated housing member 25 substantially channel-shaped in cross section having a top wall 26, right angled side walls 27 and 28 and said side walls respectively having right angled flanges **27*a* and 28*a*** extending outwardly oppositely therefrom.

Suitably attached at one end of said housing member by a conventional channel-type hinge bracket 30 is an extended portion 32 of said housing member 25 having a closed end wall 33 and being of a length to extend over the width of the gutter pipe 16 as indicated in FIGS. 1 and 2 and extending somewhat therebeyond.

Figure 3:
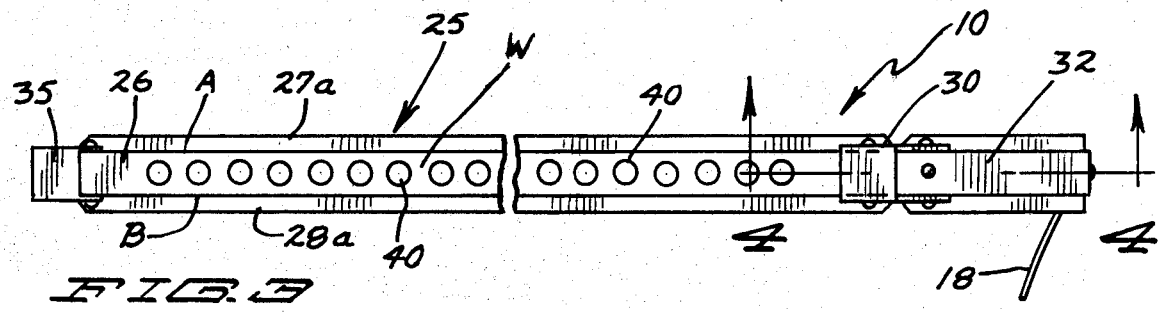
FIG. 3 is a top plan view.

The other end portion of said housing terminates in a beveled cap portion 35 as indicated in FIGS. 1 and 3.

As shown in FIG. 3 the top wall 26 of said housing member has a multiplicity of spaced apertures 40 for substantially the full length thereof.

Said housing member as described has uniform thickness and its configuration and the details thereof are readily adaptable to be produced by automatic forming equipment on a production basis from uniform flat sheet stock material. This results in a very economical manufacturing process.

As above described, said housing member of said device 10 is a substantially U-shaped channel member. Referring to FIGS. 4 and 5, disposed within said housing member in the embodiment here presented is a suitable electrically insulating member 42 having a bottom wall 43 forming the bottom wall of said housing member and having spaced side walls 45 and 46 disposed at and engaging the inner sides of the walls 27 and 28 and thus forming a chamber 47 there. Said walls 45 and 46 at their upper outer corner portions **45*a* and 46*a* have open sided grooves 49 and 50** running the full length thereof, said grooves being open to the adjacent surface of the corners formed between the top and side walls of said housing member.

The extended portion 32 of said housing member has therein an insulating member 42' of a material like that of said member 42 and is formed as a solid insert conforming to said extended portion 32 and terminating in an outer end insulating plate 53. Though not shown, said member 42' will have grooves therethrough corresponding to the grooves 49 and 50 as indicated by the groove 50'.

Extending through said grooves 49 and 50 for the entire length of said housing member and through the grooves of the extended portion 32 thereof is a continuous heating electrical conductor 55, the same being connected with said lead wire 18 which runs to a power source as shown in FIG. 6.

Said housing member of said device will be suitably formed of a highly efficient heat conductive material such as aluminum.

The particular embodiment here described is also indicated as having an outer white color painted surface finish, as indicated by W in FIG. 3, a white surface finish has been found to have a high coefficient of emmisivity which works to excellent advantage in radiating heat. The factor of emissivity efficiency of the white painted surface is approximately 400% greater than that of unfinished metal surfaces. This factor permits the use in the device herein of higher resistance heating wires than could otherwise be useable.

It will be seen that said insulating member 42 as here formed has a chamber 47 extending the full length thereof underlying the apertured top surface 26.

It is well known that the purpose of providing means for melting ice and snow on a roof surface during the winter season is to provide drain channels for water which would otherwise dam or build up under snow responsive to solar heat. Unless there is a relief channel for such water build-up, such as a drain channel, the water tends to find its way underneath roof shingles and into the attic area and wall cavities as of a dwelling.

The device 10 is very simple to place in an operating position. It is merely placed upon the roof as illustrated in FIG. 1. It may be held in position in various convenient ways and as shown in FIG. 5, a pair of offset plate like clips 60 may be suitably secured to the roof and have portions overlying and securing the flanges 27*a* and 28*a*. The clips may be readily loosened for removal of the device. In being installed prior to winter weather, preferably it will be positioned as shown in FIG. 1, with the apertured top wall facing upwardly and the heating coils being adjacent the upper corners as of A and B with reference to FIGS. 3 and 5. This provides the maximum transfer of heat during the period of a snowfall with the snow melting upon engagement with the housing.

In the situation as when there has been a substantial snowfall and ice build-up prior to the placement of the device in operating position, preferably the device will be positioned as indicated in FIGS. 6 and 7 by being placed on ice and snow covered roof portion. The ice tends to build up and be thickest adjacent the roof edge and taper or reduce in thickness as it extends upwardly. The ice will generally be snow covered. The ice and snow coverage are indicated in FIG. 6 by the characters I and S. The ice thus tends to dam up water causing it to find its way under the roof shingles and cause leakage into the structure.

In being positioned upon the ice and snow coverage as indicated in FIG. 6, the device will soon cause sufficient melting to form a drain channel, such as in FIG. 1, but initially is merely placed as shown secured at its upper end portion by a wire 63 having a self-formed hook 63*a* at one end disposed through one of said apertures 40 and having a suitable clip 64 at its other end which will be secured to the nearest shingle edge portion. If necessary the snow cover upwardly of the roof from the ice build-up can be cleaned as by a roof rake to bare a shingle to which the clip 64 may be secured. As the drain channel is formed, the device will become lowered to rest upon the roof surface.

It is noted that in FIGS. 6 and 7, the device is in an upside down position with the top wall facing downwardly and the heating coils at the corners A and B directly overlying the ice and snow cover of the roof.

The device as herein described has proved to have unusual efficiency and it is believed from the tests made that the operating expense is on the order of 70% less than the cost in heating prior art heating cables for a like purpose.

A prior art heating cable in general is rated for 1,000 watts for coverage of a 40 foot length of roof section. The device herein has a rating of 50 watts per unit. The placement of five units of the device herein upon a like length of roof section with a rating of fifty watts per unit for equal or improved results has a total rating of only 250 watts. This is a 75% reduction in wattage usage and combined with this is the relative ease of the placement of the device.

It will of course be understood that various changes may be made in form, details, arrangement and proportions of the parts without departing from the scope of the invention herein which, generally stated, consists of an apparatus capable of carrying out the objects above set forth, in the parts and combinations of parts disclosed and defined in the appended claims.

What is claimed is:

1. A roof surface ice and snow melting device comprising an elongated channel member of heat conductive material forming a housing, said channel member having a top wall, side walls and an open bottom, a heating cable disposed within said channel member, insulting means securing said cable in contrast with said wall, supporting means for said channel member, means hingedly securing to said channel member an end portion thereof, and said end portion extending over a gutter pipe.

2. The structure of claim 1, wherein said top wall of said channel member has a multiplicity of apertures therein.

3. A roof surface ice and snow melting device comprising an elongated channel member having an open bottom, a top wall and adjoining side walls, a heating cable disposed within said channel member along the junctures of said top and side walls, an insulating member disposed within said channel member conforming thereto and securing said heating cable, means hingedly connecting to said channel member an end portion thereof, said end portion being angled in operating position to overlie a gutter pipe, and a line connecting said cable with a power source.

4. The structure set forth in claim 3 said heating cable being unitary.

5. The structure set forth in claim 3 said top wall having a multiplicity of apertures there along.

6. The structure set forth in claim 3, wherein said top wall has a multiplicity of apertures therein, and said insulating member forms a chamber underlying said top wall.

7. The structure set forth in claim 3, including means removably securing said device in operating position.

8. The structure set forth in claims 1 or 3, wherein said channel member includes an exterior surface coating havinng a high coefficient of emissivity in radiating heat.

9. The structure set forth in claims 1 or 3, wherein said channel member includes an exterior surface having a high coefficient of emissivity in radiating heat.

10. The structure set forth in claim 1 or 3, wherein said channel member is of uniform thickness and adapted to be formed readily of flat stock sheet material.

* * * * *